US005803044A

United States Patent [19]

Kato

[11] Patent Number: 5,803,044

[45] Date of Patent: Sep. 8, 1998

[54] THROTTLE VALVE SYNCHRONIZATION MECHANISM

[75] Inventor: Masahiko Kato, Hamamatsu, Japan

[73] Assignee: Sanshin Kogyo Kabushiki Kaisha, Hamamatsu, Japan

[21] Appl. No.: 656,396

[22] Filed: May 31, 1996

[30] Foreign Application Priority Data

May 31, 1995 [JP] Japan ..... 7-134429

[51] Int. Cl.[6] ..... F02D 9/10; F02D 11/04

[52] U.S. Cl. ..... 123/336; 123/583

[58] Field of Search ..... 123/400, 336, 123/579, 583

[56] References Cited

U.S. PATENT DOCUMENTS

| | | | |
|---|---|---|---|
| 3,030,819 | 4/1962 | Edelbrock | 123/579 |
| 3,035,601 | 5/1962 | Moseley | 123/579 |
| 4,632,082 | 12/1986 | Hattori et al. | 123/325 |
| 4,823,748 | 4/1989 | Ampferer et al. | 123/336 |
| 4,971,006 | 11/1990 | Imaeda | 123/400 |
| 4,995,370 | 2/1991 | Imaeda | 123/583 |
| 5,326,293 | 7/1994 | Shishido et al. | 440/76 |
| 5,517,963 | 5/1996 | Yoshida et al. | 123/336 |
| 5,517,977 | 5/1996 | Nakai et al. | 123/583 |
| 5,524,596 | 6/1996 | Nakai et al. | 123/583 |
| 5,535,718 | 7/1996 | Nakai et al. | 123/336 |

FOREIGN PATENT DOCUMENTS 2-119947 9/1990 Japan .

*Primary Examiner*—Willis R. Wolfe

*Attorney, Agent, or Firm*—Knobbe, Martens, Olson & Bear, LLP

[57] ABSTRACT

A throttle valve synchronization mechanism for a marine engine includes a throttle linkage which improves synchronization of throttle valve operation, while minimizing the opening degree of the throttle valves when moved to a closed position. The throttle linkage includes a linkage rod which carries a plurality of lugs. The lugs extends between the linkage rod and corresponding throttle levers of the throttle valves. The lugs are rotatably connected to the throttle levers and are rigidly fixed to the linkage rod. In one embodiment, the linkage rod lies in front of the throttle levers, and in another embodiment, the linkage rod lies to the side of the throttle levers.

35 Claims, 11 Drawing Sheets

THROTTLE VALVE SYNCHRONIZATION MECHANISM

BACKGROUND OF THE INVENTION

1. Field of the Invention

The present invention relates in general to an internal combustion engine, and more particularly to a valve synchronization mechanism for an engine induction system.

2. Description of Related Art

Conventional engines which power an outboard motor typically include a plurality of throttle valves to regulate the amount of air delivered to each cylinder of the engine. A throttle linkage commonly interconnects the throttle shafts of the throttle valves. The linkage generally synchronizes the operation of the throttle valves to stabilize engine rotation.

A throttle linkage commonly includes a series of aligned linkage rods which operate a plurality of throttle levers. One end of the throttle lever is connected to a throttle shaft which operates the throttle valve. The levers are placed parallel to one another, and the series of linkage rods join together the outer ends of the levers. Conventional clips connect the linkage rods to the levers. The clips generally are rotatably connected to the levers and are resin-bonded to the ends of the linkage rods. The in-line series of linkage rods operate the levers to control the positions of the throttle shafts.

The points at which the clips connect with the levers lie along an axis of the in-line series of linkage rods. In prior designs with this linkage construction, at least one of the linkage rod tends to interfere with a corresponding valve shaft of the throttle valve when the throttle valves are closed. The throttle valve thus cannot be moved toward a fully closed position.

In addition, the constant percussive interference and rubbing between the linkage rod and the corresponding valve shaft tends to damage the linkage, especially affecting the resin joint between the linkage rod and the clip. As a result of the damaged joint, the clip and corresponding linkage rod may slip relative to each other. Such slippage leads to mis-synchronization between the throttle valves.

SUMMARY OF THE INVENTION

A need therefore exists for a throttle valve synchronization mechanism which improves synchronization of throttle device operation, while fully closing the throttle device when moved to a closed position.

One aspect of the present invention involves a throttle assembly for an engine. The throttle assembly includes a plurality of throttle devices which communicate with the engine and a throttle linkage which interconnects the throttle devices so as to synchronize the operation of the devices. Each throttle device comprises an operator that includes a throttle lever attached to the throttle linkage. The operators are arranged such that a common axis extends through each lever at a point of attachment between each lever and the linkage. The throttle linkage includes an elongated link to which each throttle lever is coupled. The link is arranged so as to be offset from the common axis.

Another aspect of the present invention involves a throttle linkage which extends between a plurality of throttle devices of an engine. The throttle linkage interconnects and synchronizes the operation of a plurality of operators of the throttle devices. The throttle linkage comprises a plurality of lugs. Each lug includes a connector which is coupled to the operator of one of the throttle devices. A linkage rod interconnects the lugs. Each lug is rigidly attached to the rod and is spaced apart from one another along the length of the rod.

In accordance with an additional aspect of the present invention, a throttle assembly for an engine is provided. The throttle assembly comprises a plurality of throttle devices which communicate with the engine. Each throttle devices comprises an operator which controls an opening degree of a throttle valve. The operator moves the throttle valve between a wide-open position and a closed position. Means for actuating the operators in a synchronized manner and for moving the throttle valves into the closed position also are provided.

Another aspect of the present invention involves a combination of an induction system for an engine and a valve synchronization mechanism. The induction system includes a plurality of valves which communicate with combustion chambers of the engine. Valve operators of the induction system move the valves between an open position and a closed position. The valve synchronization mechanism comprises a linkage rod coupled to each valve operator at an attachment end of each operator. The linkage rod, however, is offset from the attachment end of each valve operator. In this manner, the linkage rod interconnects the valve operators for synchronization, without interfering with the operators when the valves are closed.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
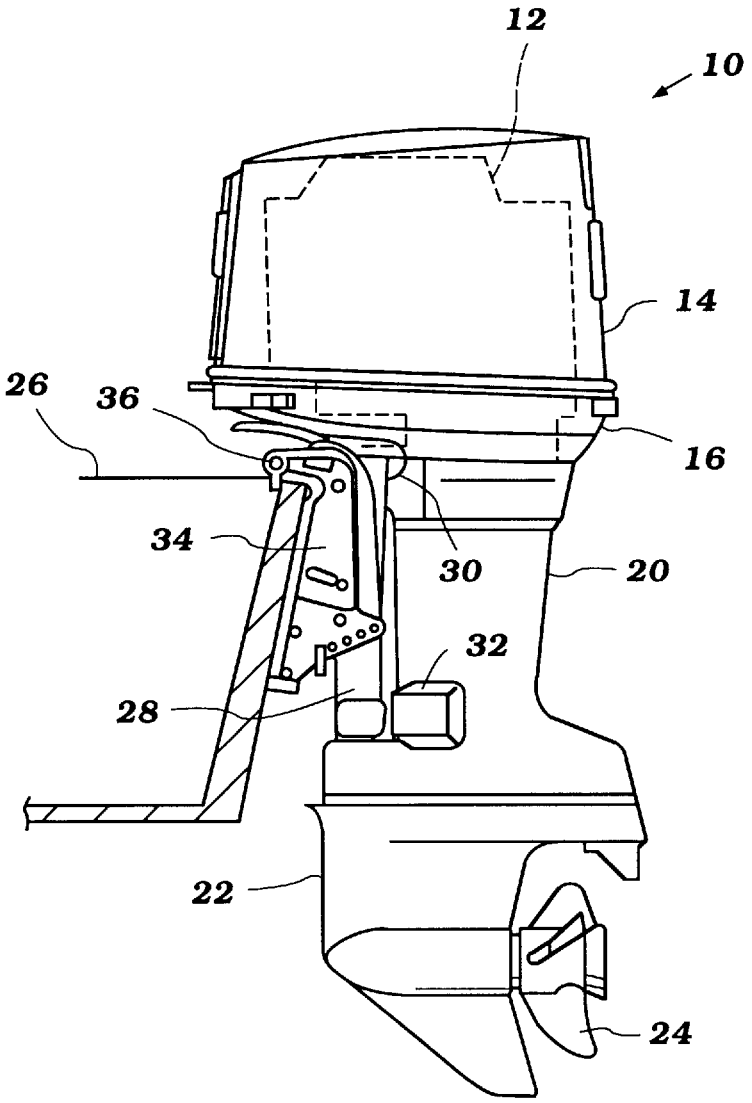
FIG. 1 is a side elevational view of an outboard motor including an engine which incorporates a throttle valve synchronization mechanism configured in accordance with a preferred embodiment of the present invention.

FIG. 1 illustrates an outboard drive 10 which incorporates a valve synchronization mechanism configured in accordance with the present invention. Because the present valve synchronization mechanism has particular utility with an outboard motor employing a vertically-oriented engine, the valve synchronization mechanism is described below in connection with an outboard motor; however, the depiction of the invention in conjunction with an outboard motor is merely exemplary. Those skilled in the art will readily appreciate that the present valve synchronization mechanism can be used with an inboard motor of an inboard/outboard drive, with an inboard motor of a personal watercraft, and with other types of watercraft engines as well.

The outboard drive 10 includes a power head that comprises an internal combustion engine 12 and a surrounding protective cowling. The cowling includes a main cowling portion 14 that is detachably connected to a tray portion 16.

The engine 12 is mounted conventionally with its crankshaft 18 (FIG. 2) rotating about a generally vertical axis. The crankshaft 18 drives a drive shaft (not shown), as known in the art. The drive shaft depends from the power head of the outboard drive 10.

A drive shaft housing 20 extends downward from the lower tray 16 and terminates in a lower unit 22. As understood from FIG. 2, the drive shaft extends through and is journaled within the drive shaft housing 20. The drive shaft depends into a lower unit 22 where it can selectively be coupled to a propulsion device 24 for driving the propulsion device 24 in selected forward or reverse directions to propel a watercraft 26. In the illustrated embodiment, the propulsion device comprises a propeller; however, other types of propulsion devices, such as, for example, a counter-rotating twin propeller system, a hydrodynamic jet pump or the like can be used as well.

A conventional forward-reverse bevel gear transmission (not shown) is provided for selectively coupling the drive shaft with a propulsion shaft to drive the propulsion device 24. The propulsion shaft drives the propulsion device 24 in a suitable known manner.

A steering shaft assembly 28 is affixed to the drive shaft housing 20 by upper and lower brackets 30, 32. The brackets 30, 32 support the shaft assembly 28 for steering movement. Steering movement occurs about a generally vertical steering axis which extends through the steering shaft assembly 28. A steering arm (not shown) which is connected to an upper end of the steering shaft assembly 28 can extend in a forward direction for manual steering of the outboard drive 10, as known in the art.

The steering shaft assembly 28 also is pivotably connected to a clamping bracket 34 by a pin 36. The clamping bracket 34, in turn, is configured to attached to the transom of the watercraft 26. This conventional coupling permits the outboard drive 10 to be pivoted relative to the pin 36 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for appreciation and understanding of the present invention.

Figure 2:
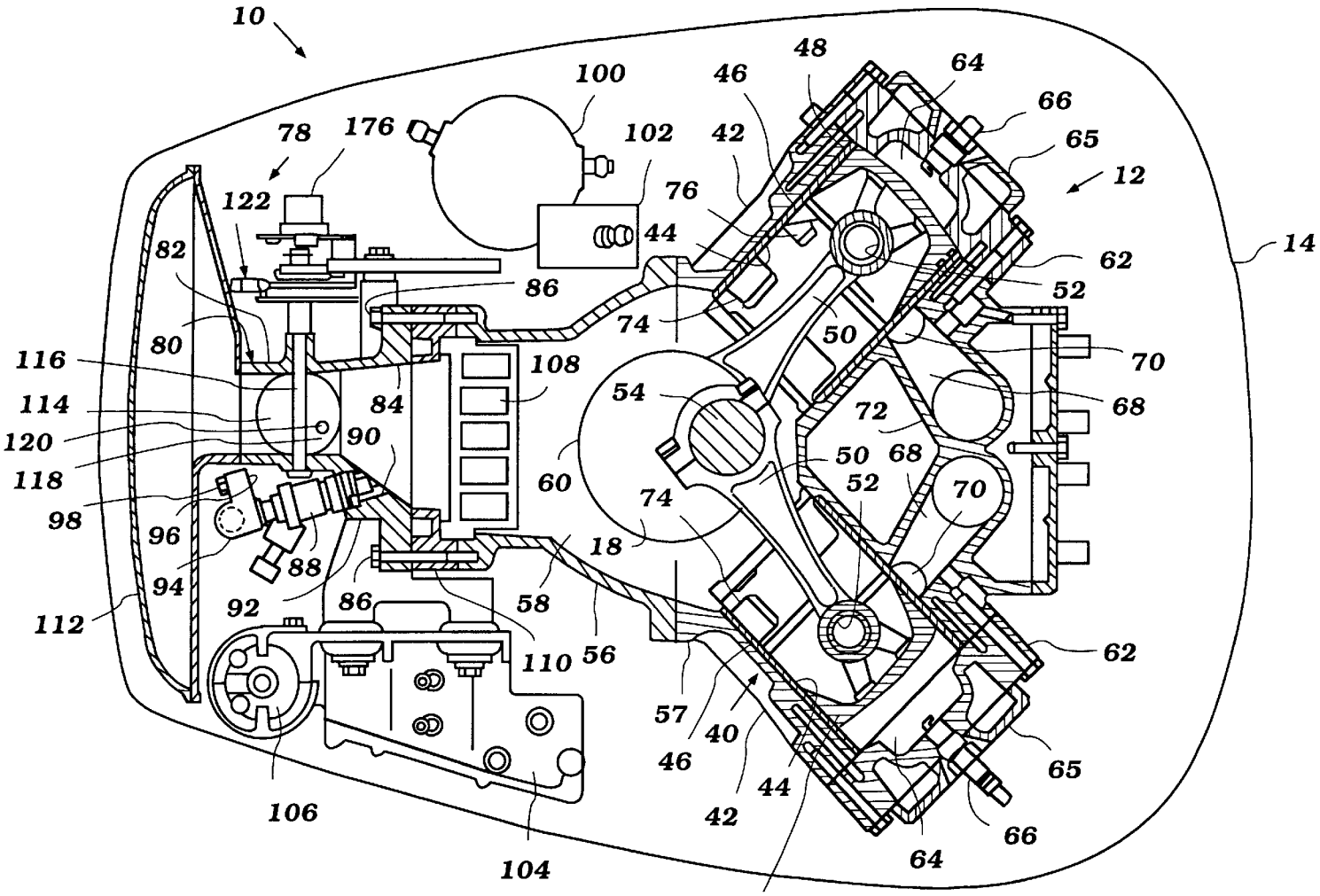
FIG. 2 is a cross-sectional, top plan view of the engine of FIG. 1 including the throttle valve synchronization mechanism.

With reference to FIG. 2, the engine 12 is, in the illustrated embodiment, a reciprocating multi-cylinder engine operating on a two-cycle crankcase compression principle. The engine 12 has a V-type configuration, though it will be readily apparent to those skilled in the art how the invention may be utilized with engines having other cylinder arrangements, such as, for example, in-line or slant cylinder arrangements, and operate on other than a two-cycle crankcase compression principle, such as, for example, a four-cycle principle.

A cylinder block assembly 40 of the engine 12 lies within the power head. The cylinder block 40 includes a pair of inclined cylinder banks 42 which extend at an angle relative to each other to give the engine a conventional V-type configuration.

Each cylinder bank 42 includes a plurality of parallel cylinder bores 44 that are formed by cylinder liners 46. Each cylinder liner 46 is cast or pressed in place in a cylinder bank 42.

Pistons 48 reciprocate within the bores 44 and are rotatably journaled about the small ends of connecting rods 50 by means of piston pins 52. The big ends of the connecting rods 50 in turn are journaled about throws 54 of the crankshaft 18.

As is typical with V-type engine arrangements, the cylinder bores 44 of the first cylinder bank 42 are offset slightly in the vertical direction from the cylinder bores 44 of the second cylinder bank 42 so that the connecting rods 50 of adjacent cylinder bores 44 can be journaled on the same throw 54 of the crankshaft 18, as shown in FIG. 2.

A crankcase member 56 and a skirt 57 of the cylinder block assembly 40 cooperate to form the crankcase. The crankshaft 18 is journaled for rotation in the crankcase. The crankcase is divided into a plurality of chambers 58, with each chamber communicating with the respective cylinder bore 44. As is typical with two-cycle crankcase compression engines, the crankcase chambers 58 associated with each cylinder bore 44 are sealed relative to each other in a manner which includes utilizing a sealing disc 60 provided on the crankshaft 18.

A pair of cylinder head assemblies 62 are affixed to the cylinder banks 42. Each cylinder head assembly 62 closes the ends of the cylinder bores 44 which are opposite to the ends that open into the crankcase chamber 58.

The cylinder heads 62 define a recess which cooperates with the bores 44 and heads of the pistons 48 to form combustion chambers 64, whose volume varies cyclicly with the motion of the pistons 48. The open upper ends of the cylinder heads 62 are sealed by covers 65 that are affixed to the cylinder heads 62 by any suitable means.

A spark plug 66 is mounted atop each recess of the cylinder head 62 and has its gap extending into the combustion chamber 64. The spark plugs 66 are fired by an ignition control circuit (not shown) that is controlled by an electronic control unit (ECU) of the engine 12.

As seen in FIG. 2, exhaust passages 68 extend away from each cylinder bore 44 of the cylinder bank 42 along the sides which face the opposite cylinder bank 42. The exhaust passages 68 open to the cylinder bores 44 at an exhaust port 70. The exhaust passages 68 of each cylinder bank 42 communicate with a common exhaust manifold 72, which routes exhaust gases through an exhaust system (not shown) for discharge from the outboard drive 10.

One or more scavenge passages (not shown) are formed within each cylinder bank 42. Each passage includes an inlet port 74 which is disposed in the lower end of the bore 44 and opens to the crankcase chamber 58, and an outlet port 76 which is disposed at a longitudinal position along the bores 44 that is slightly below and on the opposite side of the exhaust passage 68 and opens to each of the bores 44.

An induction system 78 of the engine 12 supplies a fuel/air charge to the individual crankcase chambers 58 from the crankcase side of the engine 12. The induction system 78 thus communicates with each crankcase chamber 58 on a side of the engine 12 opposite of the cylinder banks 42.

Figure 3:
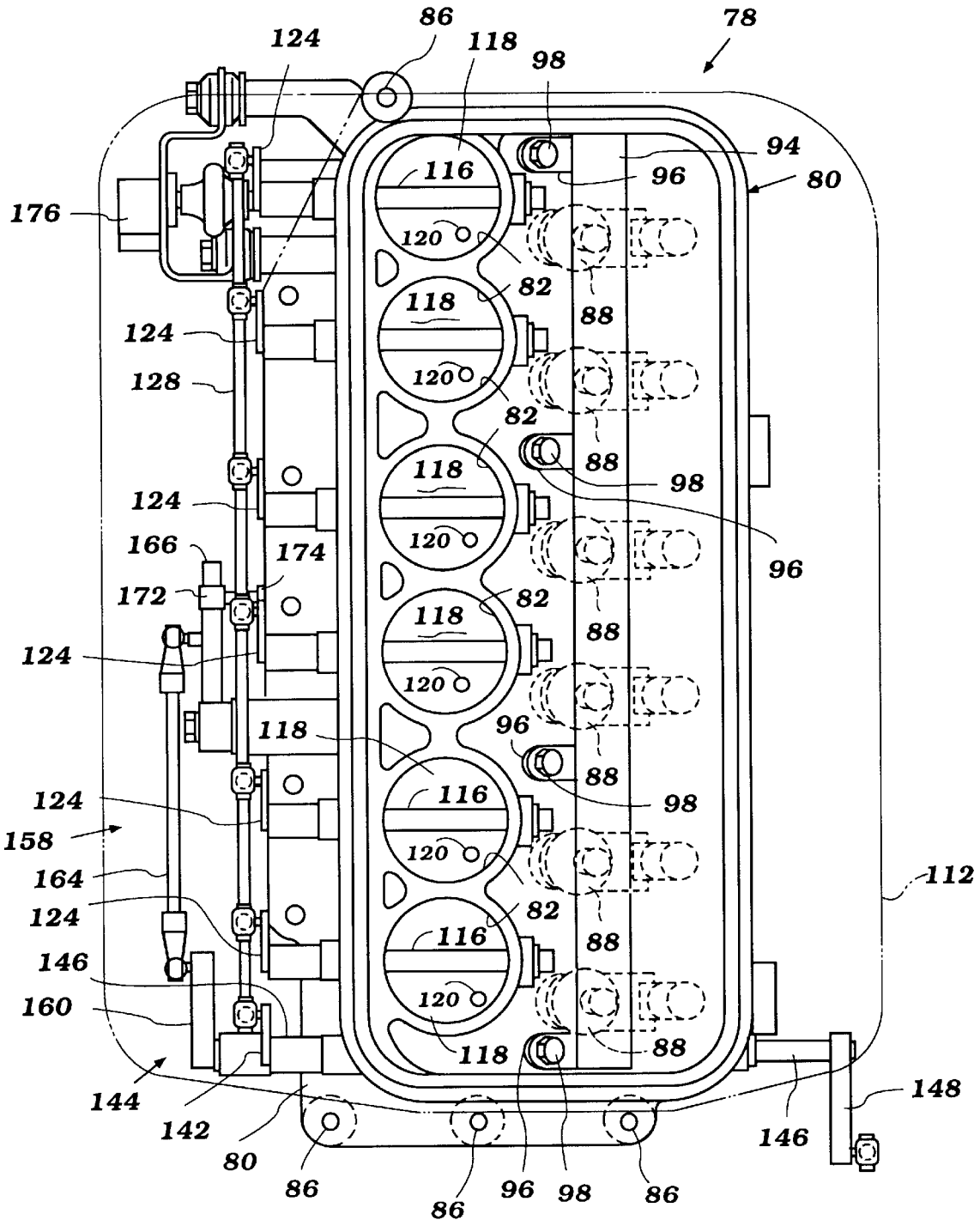
FIG. 3 is a front view of the throttle valve synchronization mechanism of FIG. 2 with a plenum chamber cover shown only in outline.

As understood from FIGS. 2 and 3, the induction system 78 includes an integral intake manifold 80. The manifold 80 defines a plurality of throttle passages 82, each of which open into a dedicated intake passage 84. Each intake passage 84 communicates with a corresponding crankcase chamber 58 of the engine 12. In the illustrated embodiment, the throttle passages 82 are aligned along a generally vertical axis so as to lie above one another.

Bolts 86 attach an outlet end of the intake manifold 80 to an end of the crankcase member 56 opposite the cylinder block assembly 40. In this position, the intake passages 84 are placed in communication with a respective crankcase chamber 58.

At least one fuel injector 88 injects fuel into the air stream passing through each intake passage 84. In the illustrated embodiment, the fuel injector 88 lies to the side of the intake passage 84, with a nozzle of the fuel injector 88 communicating with the intake passage 84 through an aperture 90. The fuel injector 88 is mounted in each intake passage 84 so that it will spray toward the center line of the intake passage 84.

A boss 92 supports the fuel injector 88 in this desired position. The boss 92 includes the aperture 90 which lies to the side of the intake passage 84 and receives a portion of the injector 88 to support the injector 88 in this position. For this purpose, the fuel injector 88 can include an external threaded section which is screwed into the aperture 90 of the boss 92.

Each fuel injector 88 includes a solenoid winding which is energized in a conventional manner. When energized, the fuel injector 88 injects fuel into the air stream passing through the intake passage 84 in the intake manifold 80. The ECU controls the fuel injector timing and thus the operation of the fuel injectors 88.

A fuel rod 94 delivers fuel to each fuel injector 88. The fuel rod 94 desirably extends along the end surface of the intake manifold 80 and is removably secured to the intake manifold 80. For this purpose, as best seen in FIGS. 2 and 3, the fuel rod 94 includes a plurality of flanges 96 which extend to the side of the fuel rod 96. Bolts 98 attach the flanges 96 to the intake manifold 80 at the upper and lower ends of the intake manifold 80, as well as at several positions therebetween. In this manner, the fuel rod 94 is securely mounted to the intake manifold 80, while being easily removed for service. The limited contact between the fuel rod 94 at its mounting flanges 96 and the intake manifold 80 also limits heat conduction to the fuel rod 94.

A fuel delivery system delivers highly pressurized fuel to the fuel rod 94. The fuel system includes a fuel tank (not shown) which is provided externally of the outboard drive, normally within the hull of the watercraft 26. With reference to FIG. 2, a low-pressure pump 100 draws fuel from the fuel tank through a conduit (not shown) and a fuel filter 102. The fuel filter 102 and low-pressure pump 100 are located within the cowling 14 on a side of the intake manifold 80 opposite of the fuel rod 94. The low-pressure pump 100 supplies fuel to a vapor separator 104 located on the other side of the intake manifold 80 (i.e., the side on which the fuel rod is located). The vapor separator 104 separates fuel vapor from the fuel and delivers the vapor to the induction system 78, in a known manner.

A high-pressure fuel pump 106 draws fuel from the vapor separator 104 and delivers fuel to the fuel rod 94 which supplies the individual fuel injectors 88, as described above. A return line connects to the vapor separator 104 to complete a high-pressure fuel circuit through which fuel is circulated. A pressure regulator desirably is disposed within the high-pressure fuel circuit so as to maintain a uniform fuel pressure at the injectors 88 (e.g., 50 to 100 atm). The regulator regulates pressure by dumping excess fuel back to the vapor separator 104, as known in the art. The above description of the construction of the fuel delivery system is generally conventionary and, thus, further details of the fuel delivery system are not necessary for an understanding of the present invention.

As seen in FIG. 2, each intake passage 84 delivers the fuel-air charge to the respective crankcase chamber 58 through a reed-type valve 108 connected to the intake manifold 80. The reed-type valve 108 permits air to flow into the crankcase chamber 58 when the corresponding piston 48 moves towards top dead center (TDC), but precludes reverse flow when the piston 48 moves towards bottom dead center (BDC) to compress the charge delivered to the crankcase chamber 58. The reed-type valves 108 are mounted to a support plate 110 that lies between the intake manifold 80 and the crankcase member.

An intake silencer or plenum chamber 112 of the induction system 78 communicates with an inlet end of the intake manifold 80. The engine 12 draws air into the plenum chamber 112 from the interior of the cowling 14 through at least one air inlet and significantly silences the intake air flow before passing through the throttle passages 84 of the intake manifold 80.

A throttle device 114 operates within each throttle passage 82 of the intake manifold 80. The plurality of throttle devices 114 control air flow into the engine 12, as known in the art.

The throttle device 114 can include any of a wide variety of type of throttling device, such as, for example, a sliding valve and butterfly valve, or the like. For the purpose of illustration, the present linkage system will be described in connection with the operation of a plurality of throttle shafts 116 which support the butterfly-type valves 118 within the throttle passages 82. Inlet air passes through the throttle passage 82 when the throttle shaft 116 is rotated to open the valve 118.

Figure 4:
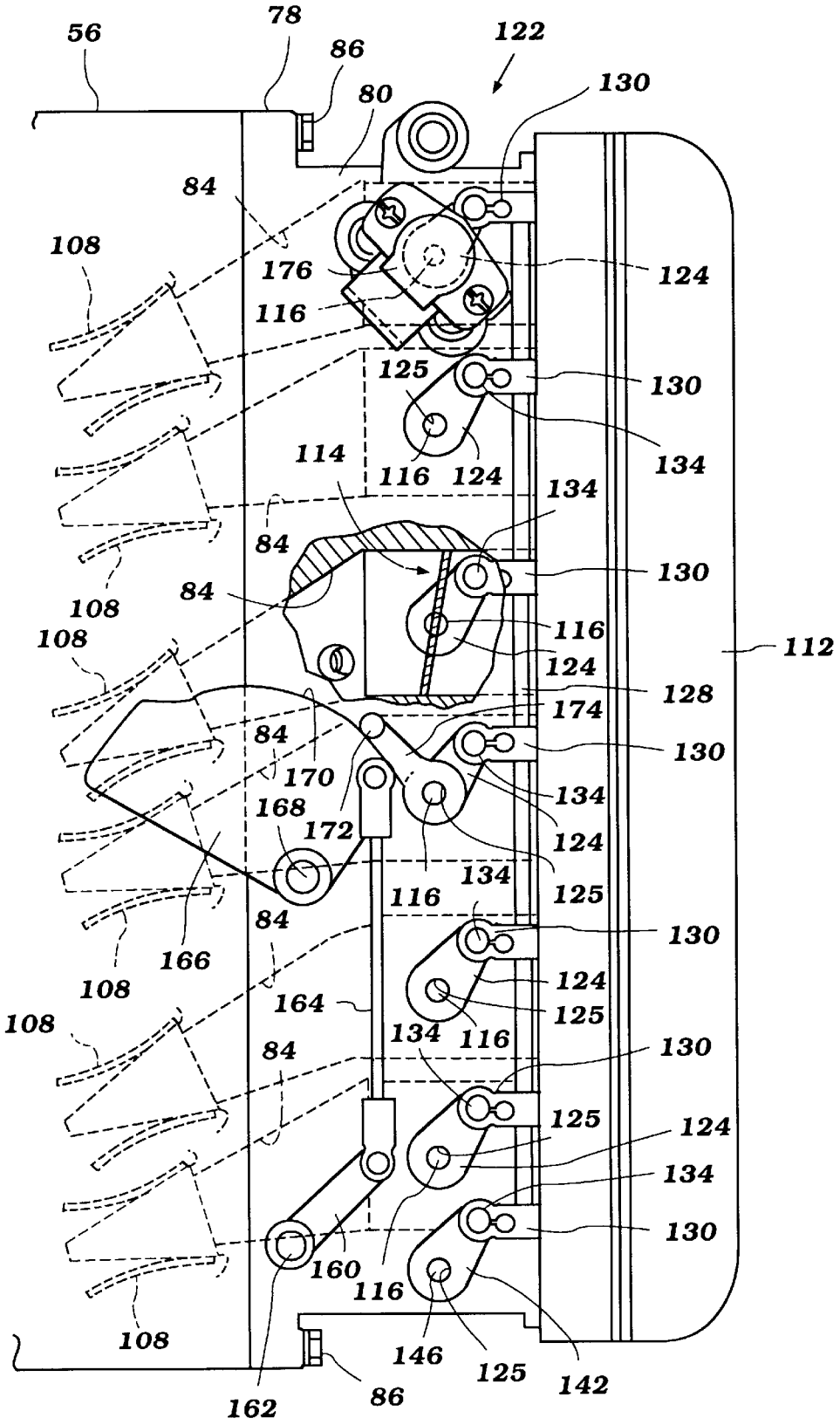
FIG. 4 is an enlarged, side elevational, partial sectional view of the throttle valve synchronization mechanism of FIG. 3.

Each valve 118 has a generally circular, disc-like shape with a diameter slightly larger than the diameter of the throttle passage 82. Thus, as seen in FIG. 4, the valve 118 does not quite lie perpendicular to the flow through the throttle body 82 when closed. The valve 118 also includes a small hole 120 positioned on the lower side of the valve 118 through which air flows when the valve 118 is closed. The hole 120 desirably lies near the aperture 90 through which the fuel injector 88 injects fuel into the intake passage 84.

In the illustrated embodiment, each throttle device 114 controls air flow into a specific crankcase chamber 58. That is, the induction system 78 includes a plurality of throttle valves 118 that correspond in number to the number of crankcase chambers 58. Each throttle valve 118 is dedicated to control the air flow into a respective crankcase chamber 58.

A throttle operator 122 operates the throttle valve 118. In the illustrated embodiment, the throttle operators 122 each include the corresponding throttle shaft 116 that supports the valve 118 within the passage 82 and a throttle lever 124. The throttle levers 124 desirably have an identical shape and size.

Each throttle lever 124 is attached to the corresponding throttle shaft 116 of the throttle device 114. An end of the throttle lever 124 is affixed onto the throttle shaft 116 by inserting the throttle shaft 116 into an aperture 125 at the end of the throttle lever 124. In the illustrated embodiment, as seen in FIG. 4, the throttle lever 124 is positioned to extend upwardly and slightly toward the inlet end of the intake manifold 80 with the valve 118 in a closed position.

The throttle levers 124 rotate from the position illustrated in FIG. 4 (i.e., a closed position) to a wide-open position in which the valve 118 lies generally parallel to the air flow through the throttle passage 84. The throttle levers 124 and associated shafts 116 rotate through a little less than 90° (e.g., 80°) to move the corresponding valves 118 between the fully closed position illustrated in FIG. 4 and the wide-open position.

The present throttle synchronization mechanism operates the throttle valves 118 in unison. The throttle synchronization mechanism includes a throttle linkage 126 connected to the throttle operators 122 so as to uniformly and simultaneously operate and control the throttle valves 118. In the illustrated embodiment, the throttle linkage 126 is coupled to each of the throttle levers 124 and lies generally parallel to the fuel rod 94. Both the fuel rod 94 and the throttle linkage 126 also extend in directions which are generally parallel to the row of throttle passages 82. In order to simplify the construction of the induction system 78, the throttle linkage 126 desirably lies on a side of the intake manifold 80 opposite of the fuel rod 94.

Figure 5:
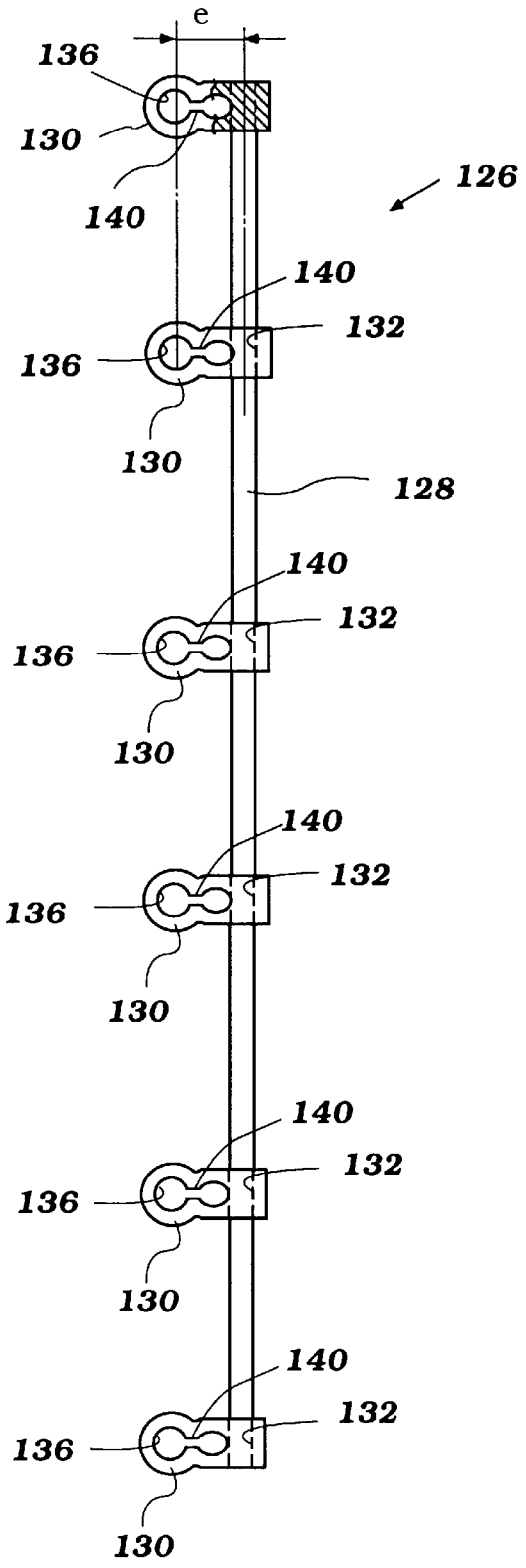
FIG. 5 is a side elevational view of a throttle linkage of the throttle valve synchronization mechanism of FIG. 3, illustrated in accordance with a preferred embodiment.

With reference to FIG. 5, the throttle linkage 126 comprises an elongated link 128. In the illustrated embodiment, the link 128 is a straight metal linkage rod. The linkage rod 128 has a length slightly smaller than the height of the intake manifold 80 (as seen in FIG. 4). The link 128, however, can take others forms. For instance, the link 128 can have an out-of-round cross-sectional shape (e.g., square), as well as various jogs along its length. The link 128 also can be formed of a plurality of interconnected pieces; however, a single metal rod is preferred.

A plurality of lugs 130 extend from the link 128. In the illustrated embodiment, each lug 130 includes a mounting aperture 132 through which a portion of the link 128 passes. The lugs 130 are positioned at various points along the link 128 which correspond with the position of the associated throttle lever 124. The lugs 130 can be resin-bonded to the link 128, or can be releasably fixed in place along the link 128 by conventional set-screws or like means. With the latter form of attachment, the throttle valves 118 can be synchronized by adjusting the position of the corresponding lugs 130 along the length of the link 128.

Each lug 130 extends to the side of the link 128. A connector 134 is formed at an outer end of the lug 130. The connector 134 is configured to attach to the lever 124 in a manner allowing rotation between the lever 124 and the lug 130. The point of attachment between the lug 130 and lever 124 desirably is offset from the longitudinal axis of the link by a distance e.

Figure 6:
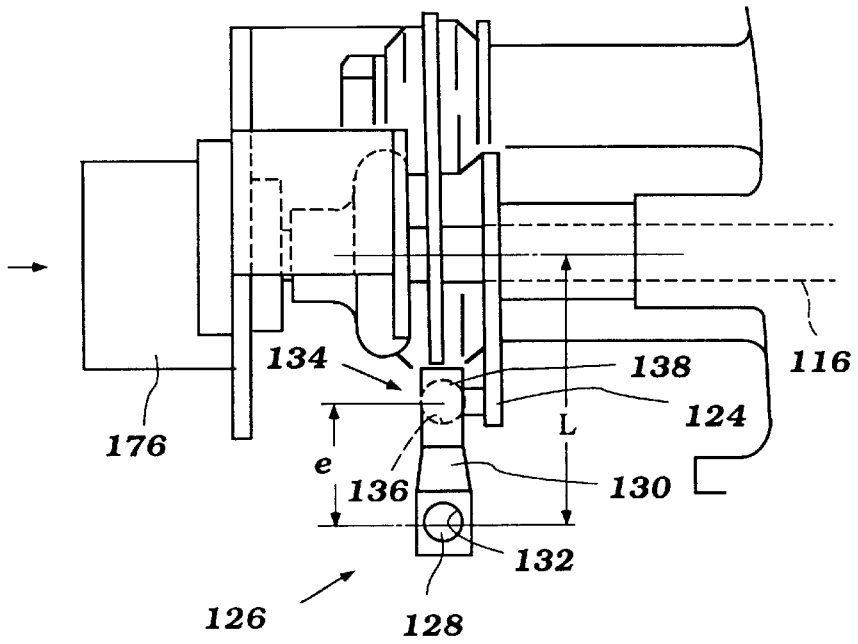
FIG. 6 is a partial top plan view of the throttle valve synchronization mechanism of FIG. 3.

In the illustrated embodiment, as best seen in FIGS. 5 and 6, the connector 134 comprises an aperture 136 which engages a snap 138 positioned on the end of the corresponding throttle lever 124. The aperture 136 is an engagement hole which has a generally spherical shape that corresponds in size to a spherically-shaped head of the snap 138. The aperture 136 also includes relief 140 positioned to the side of the engagement hole 136. The relief 140 allows the walls of the lug 130 about the engagement hole 136 to flex outwardly when the head of the snap 138 is inserted into the engagement hole 136. The lug 130 desirably is formed of an elastic plastic which returns to an undeflected state once the head of snap 138 lies within the engagement hole 136. In this manner, the connector 134 of the lug 130 receives the snap head in a snap-fit manner to inhibit disengagement between the lug 130 and the lever 124, while allowing the lug 130 and lever 124 to rotate relative to each other.

As seen in FIG. 4, each lug 130 connects to the corresponding lever 124 of the throttle operator 122. The position of the lugs 130 along the length of the link 128 correspond to the position of an engagement end of the lever 124 on which the snap 138 is formed with the throttle valve 118 lying at the same angular position. The uppermost lug 130 lies at an upper end of the link 128 and connects to the uppermost lever 124. The next to the lowermost lug 130 connects to the lever 124 of the lowermost throttle operator 122.

With reference to FIGS. 3 and 4, the lowermost lug 130 connects to a lever 142 of an oil pump actuation mechanism 144. The lever 142 is fixed to an actuator shaft 146 which extends through and is journaled within the integral body of intake manifold 80. In the illustrated embodiment, the actuator shaft 146 generally lies parallel to the throttle shafts 116 and extends entirely through the intake manifold 80. The actuator shaft 146 connects to another lever 148 on an opposite side of the manifold 80. The lever 148 in turn operates an oil pump (not shown) which injects oil into the fuel vapor separator 104 of the high-pressure fuel circuit described above.

In addition to actuating the oil pump, the actuator shaft 146 improves the rigidness of the throttle linkage 126. The actuator shaft 146, which is not connected to a throttle valve 118, resists twisting caused by the resultant forces produced by air flow over the throttle valves 118. This counter-acting effect further stabilizes the throttle linkage 126.

With reference to FIG. 4, the axis of the link 128 is offset from a common axis which passes through the snap connector 134 of each throttle lever 124. In the illustrated embodiment, the lugs 130 position the link 128 in front of the throttle levers 124. Thus, as understood from FIG. 6, the link 128 lies at a distance L from the axes of the throttle shafts 116 with the throttle valves 118 wide open. The distance L equals the combined lengths of the offset e and the distance between the throttle lever aperture 125 and the snap connector 134 (i.e., the effective length of the lever 124).

In the closed position, however, the distance L will equal the combination of the offset e plus the product of the effective length of the lever 124 times the sine of the throttle valve angle θ. The throttle valve angle θ is the angle formed between the throttle valve 118 and a plane which lies perpendicular to the flow through the throttle body 114. Thus, the offset e further distances the link 128 away from the throttle shafts 116 in both the closed and wide-open positions, whereas the offset provided by the effective length of the lever 124 decreases as the throttle valve 118 closes.

Figure 8:
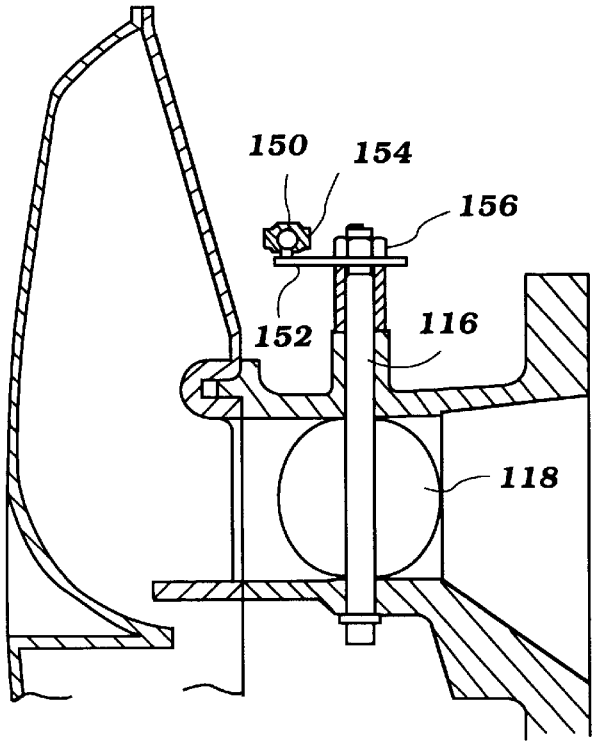
Figure 8 Prior Art
FIG. 8 is a cross-sectional view of a prior throttle valve and linkage.
Figure 9:
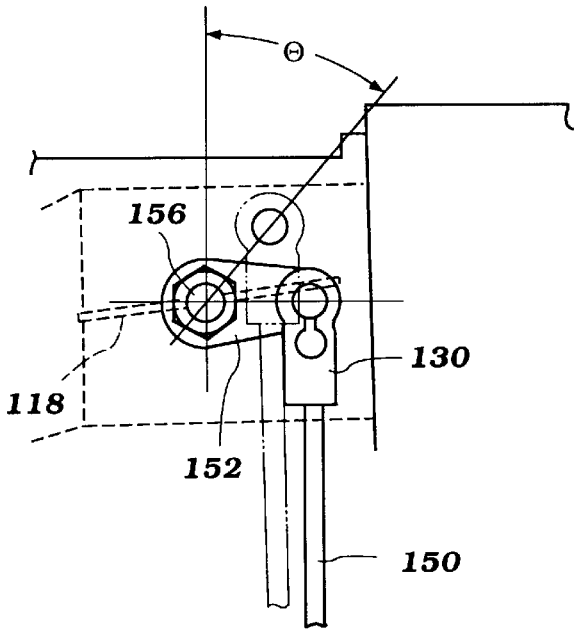
Figure 9 Prior Art
FIG. 9 is side elevational view of the throttle linkage of FIG. 8.

In order to provide the reader with a better appreciation of the present invention, a description of the operation of a prior linkage system will now be given. FIGS. 8 and 9 illustrate a joint between a prior linkage rod 118 and throttle lever 152. A clip 154 attaches the linkage rod 150 to the lever 152. The linkage rods 150 are aligned with the ends of the levers 152, such that the distance between the throttle shaft axis and the linkage rod is a function of the effective length of the lever 152.

With reference to FIG. 9, the linkage rod 150 can only move the lever 152 so far until it interferes with the end of the throttle shaft 116 and the nut 156 which secures the lever 152 to the shaft 116. The linkage rod 150 thus interferes with the throttle shaft 116 and nut 156 and the throttle valve 118 cannot be completely closed or minimized.

In addition, the linkage rod 150 and clip 154 continuously contact and rub against the throttle shaft 116 and nut 156 through repeated closings of the throttle valve 118 when the engine 12 decelerates from speeds above idle. The constant percussive contact and friction produced tends to damage the resin joint with secures the clip 154 to the linkage rod 150. As a result of the damaged joint, the clip 154 and linkage rod 150 may slip relative to each other. Such slippage leads to mis-synchronization between the throttle valves 118.

Figure 10:
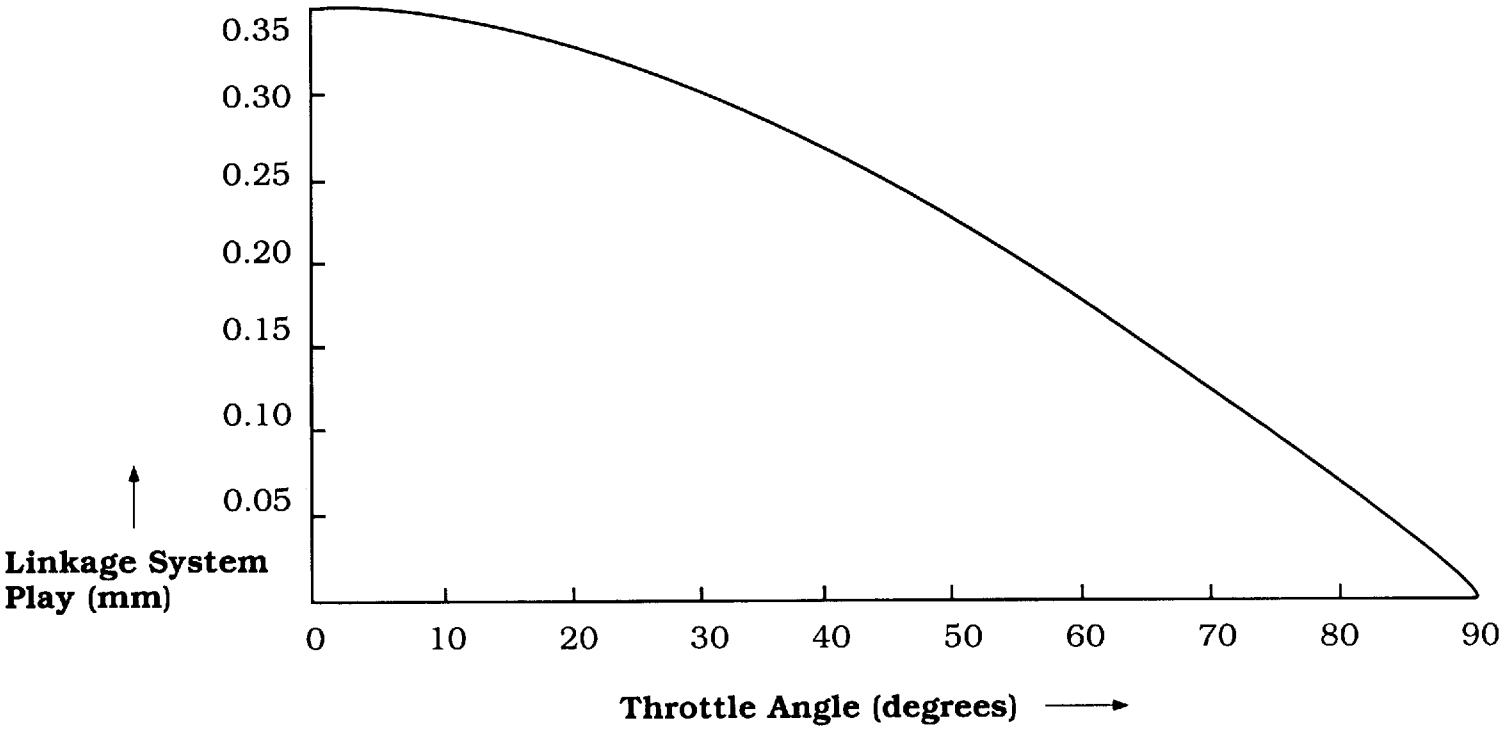
FIG. 10 is a graph illustrating the affect play or slippage within the throttle linkage has on throttle angle variation at various positions of the throttle valve between a fully closed position and a wide-open position.

Such mis-synchronization caused by slippage within the throttle linkage is exacerbated at larger throttle angles. As illustrated in FIG. 10, a 1° variation in throttle angle results from a smaller amount of slippage at large throttle angles (i.e., throttle angles approaching the wide-open position) than at smaller angles (i.e., throttle angles near the fully closed position). For instance, at about an 80° throttle angle, less than 0.05 mm of slip or play within the linkage system (i.e., between the clip 154 and the linkage rod 150) will produce a 1° angle change, while at a throttle angle of about 10°, greater than 0.3 mm of slip is necessary to produce a 1° change in throttle angle. Consequently, a small degree of play within the linkage system will significantly affect relative position of the controlled throttle valve 118. Such variations between actual throttle position and the throttle position sought to be established destroys synchronization of the throttle valves 118 and causes the engine 12 to run unevenly (i.e., roughly).

In the present throttle linkage 126 the lugs 130 position the link 128 at an offset e from the levers 124. The offset e is sufficiently large such that the link 128 does not interfere with or rub against the throttle operator 122 (e.g., throttle shaft 116) when the link 128 moves the throttle lever 124 to the closed position. In this manner, the present throttle linkage 126 eliminates the contact between the linkage 128 and the throttle shafts 116 by offsetting the axis of the link 128 from the end of the throttle levers 124. The present linkage system thus is less susceptible to play developing between the components of the linkage system.

The offset e also is of a sufficient size to allow the throttle lever 124 to be rotated to a fully closed position. As a result, the linkage 128 can move the throttle valve 118 between a fully closed position and a wide open position.

With reference back to FIGS. 3 and 4, an actuator mechanism 158 of the present throttle valve synchronization system actuates the throttle linkage 126. The actuator mechanism 158 includes an actuator lever 160 which rotates about a shaft 162 fixed to the exterior of the intake manifold 80. The actuator lever 180 can be operated by a conventional throttle controller including bowden-wire cables.

A linkage rod 164 connects the actuator lever 160 to a rotatable cam 166. The cam 166 rotates about a support shaft 168 fixed to the exterior of the intake manifold 80. The cam 166 includes an arcuate cam surface 170 positioned on an outer edge of the cam 166.

A follower 172 cooperates with the cam surface 170 to move over the cam surface 170 as the cam 166 is rotated by the actuator lever 160. The follower 172 is connected to a second actuator lever 174 which is coupled to one of the throttle levers 174. The second actuator lever 174 desirably is coupled to the throttle lever 124 in a manner which causes the actuator lever 174 and the throttle lever 124 to move together. In the illustrated embodiment, these two levers are jointed together such that the throttle lever 124 rotates with the actuator lever 174. The actuator lever 174 thus also rotates the corresponding throttle shaft 116 and valve 118. The actuator lever 174 desirably is coupled to the third throttle device 114 up from the bottom of the intake manifold 80.

Although not illustrated, a biasing mechanism desirably biases the throttle valves 118 to the closed position. The biasing mechanism desirably is one or more torsion springs disposed between the throttle levers 124 and the intake manifold 80 and/or between the oil pump actuator lever 148 and the intake manifold 80. The biasing mechanism acts against the movement imparted to the linkage system 126 by the actuator mechanism 158.

Figure 7:
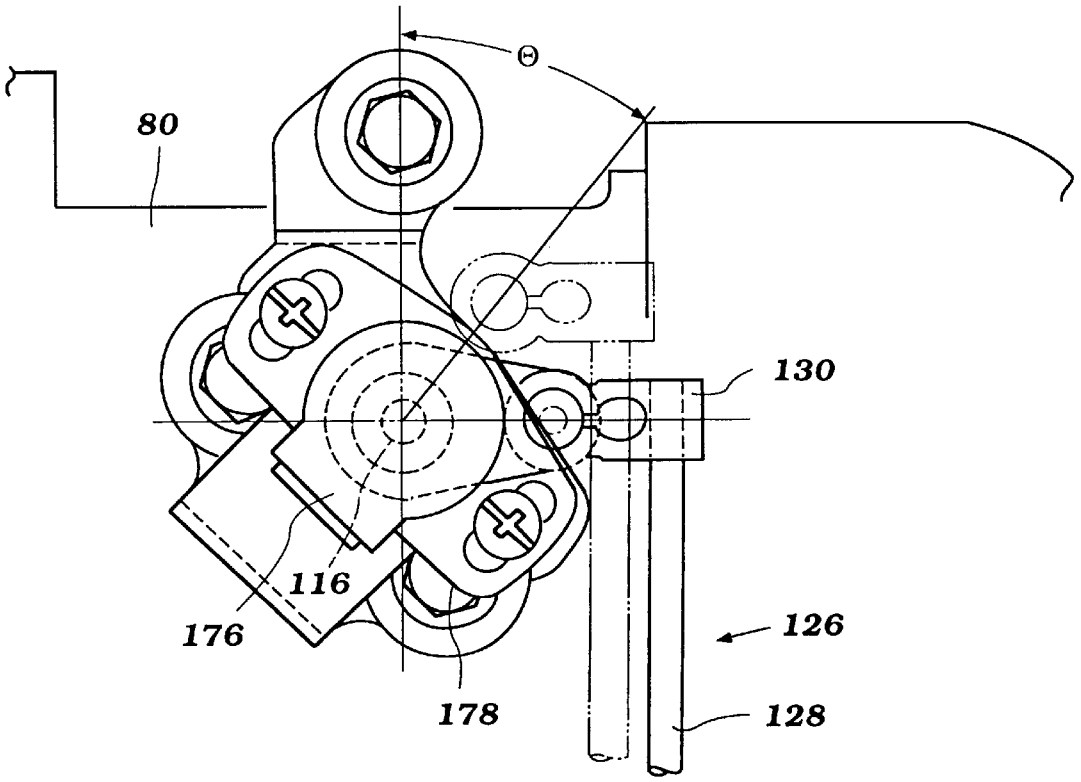
FIG. 7 is a partial side elevational view of the throttle valve synchronization mechanism of FIG. 6.

As best seen in FIGS. 6 and 7, a throttle valve angle detector 176 can be used with the throttle linkage 126 in order to sense the opening degree of the throttle valves 118. The throttle angle detector 176 communicates with the electronic control unit (ECU) (not shown) to control the desired air/fuel ratio. In the illustrated embodiment, the throttle valve angle detector 176 is attached to an end of the uppermost throttle shaft 116 to sense the angular position of the uppermost throttle valve 118. A bracket 178 supports the detector 176 to the side of the throttle shaft 116.

In operation, the first actuator lever 160 is rotated to operate the throttle linkage 126 and to open the throttle valves 118. The linkage rod 164 imparts the rotational movement of the first actuator lever 160 to the cam 166. The follower 172 of the second actuator lever 174 slides over the cam surface 170 with rotation of the cam 166, and the second actuator lever 174 consequently rotates (in the clockwise direction for the embodiment illustrated in FIG. 4). Rotation of the second actuator lever 174 opens the attached throttle valve 118.

The associated throttle lever 124 transmits this rotational movement to the throttle linkage 126. The throttle linkage 126 moves downward, in the illustrated embodiment, as a result. This downward movement of the link 128 causes the balance of the throttle levers 124 as well as the oil pump actuator lever 148 to rotate clockwise. The lugs 130 of the linkage system 126 transmit the downward movement of the link 128 to the outer end of the levers 124. The rotational coupling between the lugs 130 and the levers 124 allows the angle between the lever 124 and the associated lug 130 to change with this movement.

The unitary movement of the lugs 130, which are rigidly connected to each other by the link 128, causes the throttle levers 124 to move in unison. The throttle valves 118 consequently simultaneously open with the opening degree between each valve 118 being substantially the same.

The biasing mechanism desirably bias the valves 118 closed. The interaction between the follower 172 and the cam 166, however, establishes the desired position of the throttle valves 118 as described above.

Figure 11:
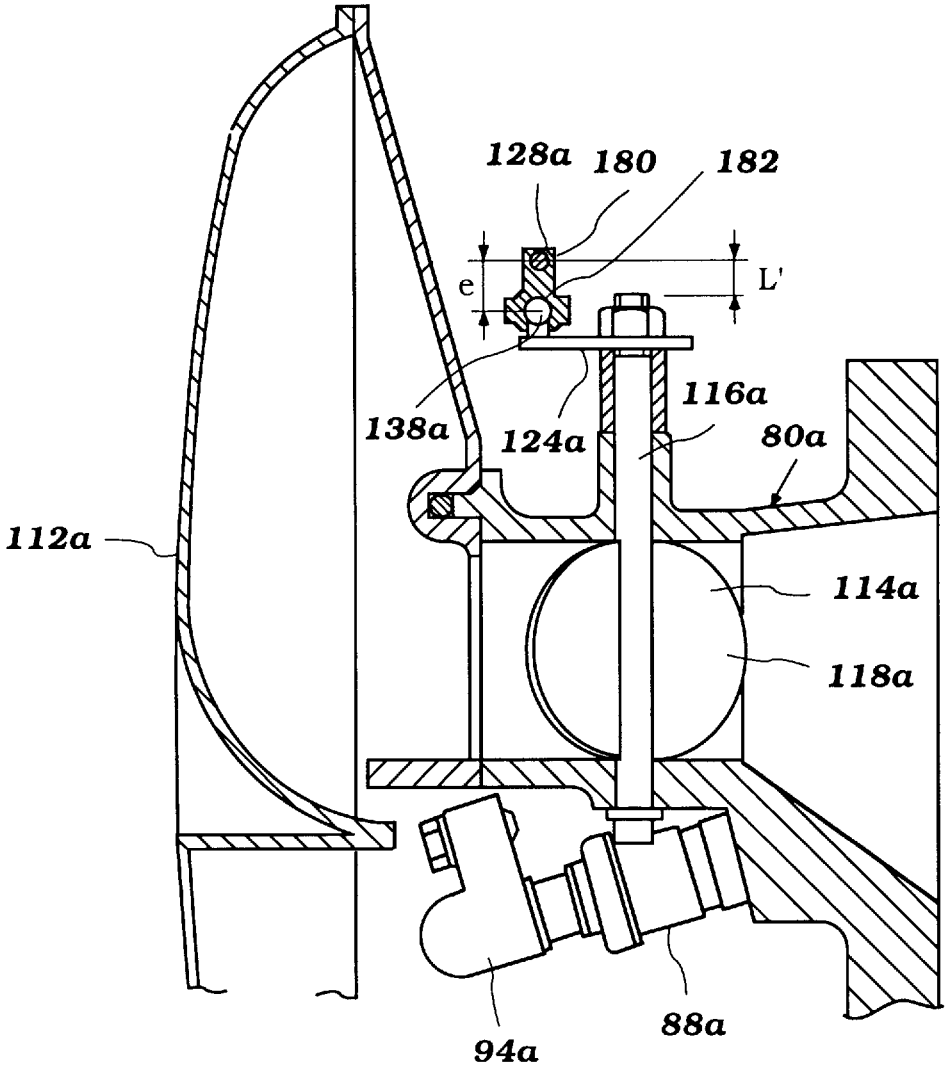
FIG. 11 is a partial, cross-sectional, top plan view of the throttle valve synchronization system including a throttle linkage configured in accordance with another preferred embodiment of the present invention.
Figure 12:
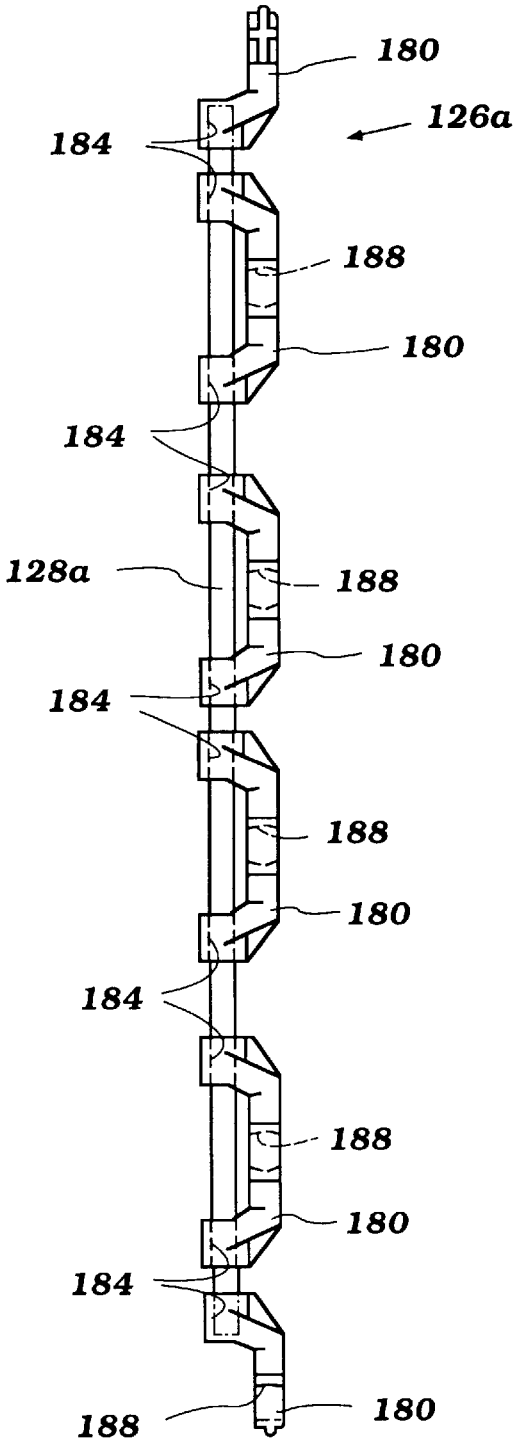
FIG. 12 is a front elevational view of the throttle linkage of FIG. 11.
Figure 13:
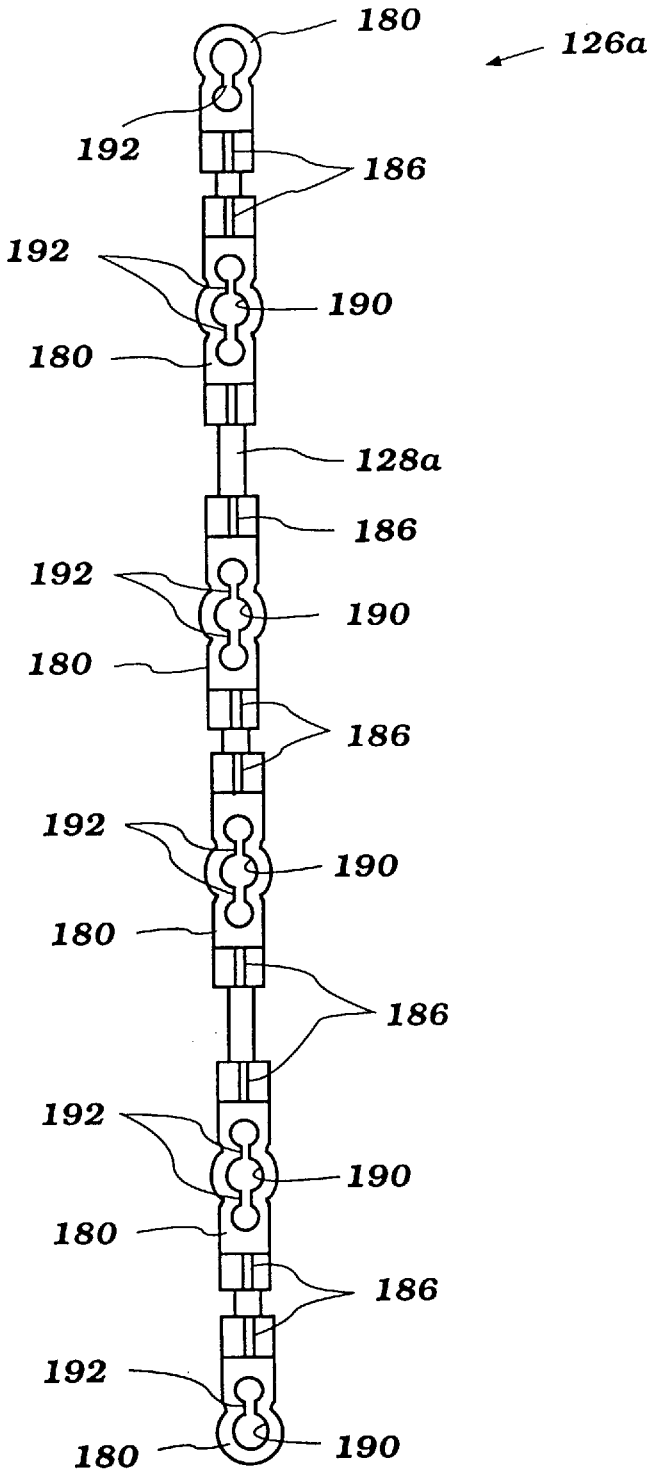
FIG. 13 is a side elevational view of the throttle linkage of FIG. 12.

FIGS. 11 through 13 illustrate another preferred embodiment of a linkage system 126 which can be used with the present throttle valve synchronization system. The linkage system 126 is substantially identical to that described above, save the configuration of the lugs. For this reason, the above description applies equally to the throttle linkage 126 of FIGS. 11 through 13. Like reference numerals with an "a" suffix will be used to indicate similar parts between the two embodiments.

As seen in FIG. 11, the lugs 180 position the link 128*a* to the side of the throttle levers 124*a*, rather than in front of the throttle levers 124*a* as in the above-described embodiment. The offset e between the throttle lever 124*a* and the axis of the link 128*a* desirably is sufficient to space the link 128*a* apart by a distance L' from the end of the throttle shaft 116*a* with the throttle shaft 116*a* in the closed position.

To produce this offset to the side of the throttle shaft end, each lug 180 includes a connector 182 which is offset from the axis of the link 128*a*. With reference to FIGS. 12 and 13, each lug 180 has an elongated, generally U-shaped body. Mounting apertures 184 extend through the ends of each arm of the body. The mounting apertures 184 are sized to receive a portion of the link 128 which passes through the apertures 184 to connect the lug 180 to the link 128*a*. As seen in FIG. 13, a slot 186 may extend through each arm in a direction of an axis of the mounting aperture 184. The slot 186 allow flexure of the lug 180 when the mounting aperture 184 receives the link 128*a*. Thereafter, the elastic nature of the plastic lug 180 tends to clamp onto the link 128*a*. The lugs 180 also are fixed to the link 128*a* by a resin-epoxy or by a set-screw, as described above.

As seen in FIGS. 12 and 13, the arms of the lug 180 support an elongated section of the body off-axis from the axis of the link 128*a*. The connector 182 is formed in this elongated body section.

The connector 182 includes an aperture 188 which engages a snap 138*a* positioned on the end of the corresponding throttle lever 124*a*. The aperture 188 includes an engagement hole 190 which has a generally spherical shape that corresponds in size to a spherically-shaped head of the snap 138*a*. The aperture 188 also includes reliefs 192 positioned to the sides of the engagement hole 190. The reliefs 192 allow walls of the lug 180 about the engagement hole 180 to flex outwardly when the head of the snap 138*a* is inserted into the engagement hole 190. The lug 180 desirably is formed of an elastic plastic which returns to an undeflected state once the head of snap 138*a* lies within the engagement hole 190. In this manner, the connector of the lug 180 receives the snap head 138*a* in a snap-fit manner to inhibit disengagement between the lug 180 and the lever 124*a*, while allowing the lug 180 and lever 124*a* to rotate relative to each other.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A throttle assembly of a marine engine comprising a plurality of throttle devices which communicate with the engine and a throttle linkage which interconnects said throttle devices so as to synchronize the operation of said throttle devices, each throttle device comprising an operator that includes a throttle lever attached to said linkage, said throttle operators being arranged such that a common axis extends through each throttle lever at a point of attachment between each throttle lever and said linkage, said linkage including an elongated link to which each throttle lever is coupled, said link arranged so as to be offset from said common axis.

2. A throttle assembly as in claim 1, wherein said common axis and a longitudinal axis of said link lie generally parallel to each other.

3. A throttle assembly as in claim 1, wherein said common axis extnds generally in a vertical direction.

4. A throttle assembly as in claim 1, wherein each operator selectively established a closed position of the corresponding throttle device, and said offset being sufficiently large such that said link does not interfere with said operators with said throttle devices in said closed position.

5. A throttle assembly as in claim 1 additionally comprising an oil pump actuator shaft coupled to said link by a lever.

6. A throttle assembly as in claim 5, wherein throttle passages of said throttle devices are integrally formed together within an intake manifold, said throttle devices each additionally comprising a throttle valve supported by a throttle shaft within one of said throttle passages, and said oil pump actuator shaft extends through and is journaled within said intake manifold, said oil pump actuator shaft lying generally parallel to said throttle shafts.

7. A throttle assembly as in claim 1 additionally comprising an actuator mechanism coupled to said linkage to move said throttle operators generally in unison.

8. A throttle assembly as in claim 7, wherein said actuator mechanism comprises an actuator which moves a cam, and an actuator lever including a follower which cooperates with said cam, said actuator lever being connected to one of said throttle levers such that said actuator lever and said throttle lever move together.

9. A throttle assembly as in claim 8, wherein said actuator additionally comprises an actuator rod interconnecting an actuator lever with said cam.

10. A throttle assembly as in claim 1, wherein said linkage additionally comprises a plurality of lugs, each lug connecting one of said throttle levers to said link.

11. A throttle assembly as in claim 10, wherein said offset of said link from said common axis is desirably equal to a distance between a point of attachment between said lug and said throttle lever and a point of attachment between said lug and said link.

12. A throttle assembly as in claim 12, wherein each lug is rotatably coupled to one of said throttle levers and is fixed to said link.

13. A throttle assembly as in claim 12, wherein said link comprises a rod.

14. A throttle assembly as in claim 10, wherein said lug comprises a mounting aperture through which a portion of said link extends and a connector which engages with a portion of said throttle lever.

15. A throttle assembly as in claim 14, wherein said connector comprises a coupling aperture which receives a portion of a snap carried by said throttle lever.

16. A throttle assembly as in claim 15, wherein an axis of said coupling aperture lies generally transverse to an axis of said mounting aperture of said lug.

17. A throttle assembly as in claim 14, wherein at least several of said plurality of lugs comprises two mounting apertures through which said link extends.

18. A throttle assembly as in claim 17, wherein said several of said lugs each include a pair of arms which support a portion of said lug in which said coupling aperture is formed at a distance from an axis of said elongated link.

19. A throttle assembly as in claim 18, wherein said distance generally equals said offset between said link and said common axis.

20. A throttle linkage extending between a plurality of throttle devices of an engine to interconnect and synchronize the operation of a plurality of operators of the throttle devices, said throttle linkage comprising a plurality of generally rigid lugs, each lug including a connector which is coupled to an operator of one of the throttle devices, and a linkage rod interconnecting said lugs, each lug being rigidly attached to said linkage rod and being spaced apart from one another along said linkage rod.

21. A throttle linkage as in claim 20, wherein spacing between adjacent lugs is generally equal to the spacing between adjacent throttle operators.

22. A throttle linkage as in claim 20, wherein each lug includes at least one mounting aperture through which at least a portion of said linkage rod extends.

23. A throttle linkage as in claim 22, wherein said mounting aperture of each lug is distanced from said connector of said lug.

24. A throttle linkage as in claim 23, wherein said throttle device includes a throttle valve supported by a throttle shaft of said operator, said throttle shaft moving said throttle valve between an open position and a closed position, and said distance between said mounting hole and said connector of each lug is sufficiently large to space said link apart from the corresponding throttle shaft with said throttle valve in said closed position.

25. A throttle linkage as in claim 22, wherein said connector comprises a coupling aperture which receives a portion of a snap carried by said throttle lever.

26. A throttle assembly for an engine comprising a plurality of throttle devices which communicate with the engine, each throttle devices comprising an operator which controls an opening degree of a throttle valve of said throttle device, each operator moving said throttle valve between a wide-open position and a fully closed position, and means for actuating said operators in a synchronized manner between said fully closed position and said wide-open position, said means being attached to said operators at points along a common axis.

27. A throttle assembly as in claim 26, wherein a throttle lever of each operator is rotatably coupled to said means for actuating said operators.

28. A throttle assembly as in claim 26 additionally comprising an actuator mechanism coupled to said linkage to move said throttle operators generally in unison.

29. A throttle assembly as in claim 28, wherein said actuator mechanism comprises an actuator which moves a cam, and an actuator lever including a follower which cooperates with said cam, said actuator lever being connected to one of said throttle levers such that said throttle lever moves with said actuator lever.

30. In combination an induction system of an engine and a valve synchronization mechanism, said induction system including a plurality of valves which communicate with combustion chambers of said engine, and valve operators which move said valves relative to a respective axis of each valve between an open position and a closed position, said valve synchronization mechanism comprising a linkage rod which interconnects said valve operators at an attachment end of each operator, said linkage rod being offset to one side of the valve operators attachment ends, and the axes of the valves are located on another side of the valve operator attachment ends.

31. The combination of claim 30, wherein said valves are butterfly-type valves and said operators are valve shafts.

32. The combination of claim 31, wherein said offset between said linkage rod and said attachment end of each valve operator is sufficiently large such that with said valves in said closed position, a space exists between said linkage rod and said valve shafts.

33. The combination of claim 32, wherein said valve synchronization mechanism comprises an actuator mechanism coupled to said linkage rod, said actuator mechanism comprises an actuator which moves a cam, and an actuator lever having a follower which cooperates with said cam, said actuator lever being connected to one of said throttle levers such that said actuator lever and said throttle lever move together.

34. The combination of claim 30, wherein said valve synchronization mechanism comprises a plurality of lugs which interconnect said valve operators with said linkage rod, each lug being rotatably coupled to said valve operator and fixed to said linkage rod.

35. The combination of claim 34, wherein each of said lugs comprises at least one mounting aperture through which at least a portion said linkage rod extends.

* * * * *

UNITED STATES PATENT AND TRADEMARK OFFICE

CERTIFICATE OF CORRECTION

PATENT NO. : 5,803,044

DATED : September 8, 1998

INVENTOR(S) : Masahiko Kato

It is certified that error appears in the above-identified patent and that said Letters Patent is hereby corrected as shown below:

In Claim 3, Col. 12, Line 2, "axis extnds" should be --axis extends--.

In Claim 17, Col. 12, Line 54, "lugs comprises" should be --lugs comprise--.

Signed and Sealed this

Twenty-third Day of March, 1999

*Attest:*

Q. TODD DICKINSON

*Attesting Officer*

*Acting Commissioner of Patents and Trademarks*